United States Patent [19]

Siegling et al.

[11] Patent Number: 5,041,324

[45] Date of Patent: Aug. 20, 1991

[54] WOVEN FABRIC STRUCTURE AND PROCESS OF MANUFACTURE

[75] Inventors: Hans-Friedrich Siegling, Egmating; Wolfgang Bottger, Kodnitz; Kurt Biedermann, Kulmbach, all of Fed. Rep. of Germany

[73] Assignee: Vorwerk & Co. Interholding GmbH, Wuppertal, Fed. Rep. of Germany

[21] Appl. No.: 341,811

[22] Filed: Apr. 24, 1989

[30] Foreign Application Priority Data

Apr. 23, 1988 [DE] Fed. Rep. of Germany ..... 3813740

[51] Int. Cl.[5] ..... B32B 3/16; B32B 3/30; B32B 5/28; B32B 33/00; B64C 47/00

[52] U.S. Cl. ..... 428/119; 139/304; 139/384 R; 181/293; 181/294; 244/1 N; 415/119; 428/120; 428/167; 428/172; 428/902

[58] Field of Search ..... 181/293, 294; 139/384 R, 304; 415/119; 244/1 N; 428/120, 167, 172, 902, 119

[56] References Cited

U.S. PATENT DOCUMENTS

| | | | |
|---|---|---|---|
| 793,524 | 7/1905 | Hewett | 139/384 R |
| 798,404 | 8/1905 | Flamant | 139/384 R |
| 1,988,041 | 4/1935 | Barbet | 139/384 R |
| 2,424,924 | 7/1947 | Glendinning et al. | 139/384 R |
| 3,481,427 | 12/1969 | Dobbs . | |
| 3,991,849 | 11/1975 | Green et al. | 244/1 N |
| 4,477,505 | 10/1984 | Warnaka | 181/294 |
| 4,531,609 | 7/1985 | Wolf et al. | 181/294 |
| 4,782,804 | 11/1988 | Abildskov | 139/384 R |
| 4,837,065 | 6/1989 | Dow | 428/119 |

FOREIGN PATENT DOCUMENTS

| | | | |
|---|---|---|---|
| 258102 | 3/1988 | European Pat. Off. | 139/384 R |
| 1064968 | 12/1953 | France | 181/293 |
| 2090 | of 1861 | United Kingdom | 139/384 R |
| 2980 | of 1881 | United Kingdom | 139/384 R |
| 12375 | of 1887 | United Kingdom | 139/384 R |
| 529776 | 11/1940 | United Kingdom | 181/293 |

*Primary Examiner*—James C. Cannon

*Attorney, Agent, or Firm*—Watson, Cole, Grindle & Watson

[57] ABSTRACT

A woven fabric structure impregnated with a hardened resin has first and second warp fabric sections, the second section comprising a plurality of pleats integrally joined to the first section by warp threads of the second section and interwoven with the weft threads of the first section. The fabric is of an industrial yarn such as aramide fiber, carbon fiber, ceramic fiber, glass fiber or a blend of such fibers.

7 Claims, 5 Drawing Sheets

WOVEN FABRIC STRUCTURE AND PROCESS OF MANUFACTURE

BACKGROUND OF THE INVENTION

This invention relates to a woven fabric structure and the process of manufacture of such structure. The fabric structure has a first warp fabric section and a second warp fabric section, the latter comprising a plurality of pleats integrally joined to the first section by warp threads of the second section interwoven with the weft threads of the first section. The fabric comprises an industrial yarn of aramide fiber, carbon fiber, ceramic fiber, glass fiber or a combination of such fibers. The fabric is impregnated with a resin system to form a rigid fabric structure.

Published European patent application No. 0 056 351 discloses a woven multi-layered fabric structure reinforced by separate fabric elements. The drawbacks noted for such a structure are the weakening of the joints at which the separate fabric elements are connected to the fabric structure.

U.S. Pat. No. 3,481,427 discloses a multi-layered woven fabric structure with the layers joined by connecting walls of woven fabric to form dead air cavities.

Fabric structures of this general type used as compound materials have widespread use, primarily in the aviation industry where they are used, for example, in engine chambers. To attain the desired thickness individual woven fabric layers are stacked upon one another and joined in some fashion. However, the stacking of several woven fabric panels is time consuming and cumbersome and requires a separate weaving process to prevent shifting between panels. Thus, when high-performance industrial fibers are used for the panels, the panel weave may be partially damaged during the separate weaving process.

SUMMARY OF THE INVENTION

It is therefore an object of the present invention to provide a woven fabric structure of simple construction in which the thickness of the structure can be varied during the weaving process without layering as aforedescribed.

The woven fabric structure of the invention has a first warp fabric section and a second warp fabric section, the latter comprising a plurality of pleats integrally joined to the first section by warp threads of the second section interwoven with weft threads of the first section. The fabric is made of an industrial yarn such as aramide fiber, carbon fiber, ceramic fiber, glass fiber or a combination of such fibers. The fabric is impregnated with a resin system to form a rigid fabric structure.

In accordance with the process of the invention, the first warp fabric section is woven to a predetermined length having equal first sub-lengths. The second warp fabric section is woven to a predetermined length having equal sub-lengths, the sub-lengths of the sections likewise being equal to one another. The second section is interwoven with the first section, and pleats are formed in the second section by shortening the sub-lengths of the first section. The fabric is then impregnated with a resin system to form a rigid fabric structure.

The present woven fabric structure is of one-piece construction capable of being made in various thicknesses without the time-consuming and costly layering of panels as heretofore required. The structure can be woven from fibers using techniques and weaving machines known in the art. The woven fabric retains a high grade elasticity compared to a laminate of layers sewn together or otherwise joined. The thickness of the present fabric structure is effected by the provision of rigid pleats integrally joined with the first warp fabric section. The pleat height can be varied during the weaving process so as to vary the thickness of the overall woven structure. And, since the pleats extend from the first warp section the woven fabric structure is easily manageable during production.

During the process of manufacture, the pleats are integrally joined at their free ends to the first warp section by warp threads of the second section interwoven with weft threads of the first section. In use, the woven fabric structure produced has an optimum fiber arrangement. The weft threads of the first warp fabric section comprise the holding wefts for the pleats. These threads extend in the plane of the first section and are maintained taut.

The pleats formed of the second section extend from a common side of the first section. The double-leg, comb-like pleat structure can be arranged such that the pleats form a lapped structure in the manner of roof shingles as the pleats lie at an angle to the first section. Thus, for this reason it is advantageous for the weft threads of the first section to be of thinner material than the weft threads of the pleated fabric.

During the process of manufacture, the first section sub-lengths are shortened by reversely rotating a fabric take-off roll of a weaving machine employed in the process. And, the first section is rewound onto a warp beam roll of the machine for tensioning the yarns of the first section.

DETAILED DESCRIPTION OF THE INVENTION

Figure 1:
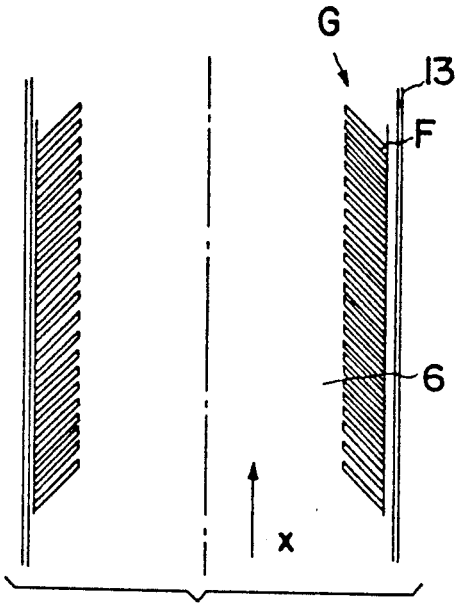
FIG. 1 is a schematic view illustrating application of the present structure which may be used for lining an engine wall.
Figure 2:
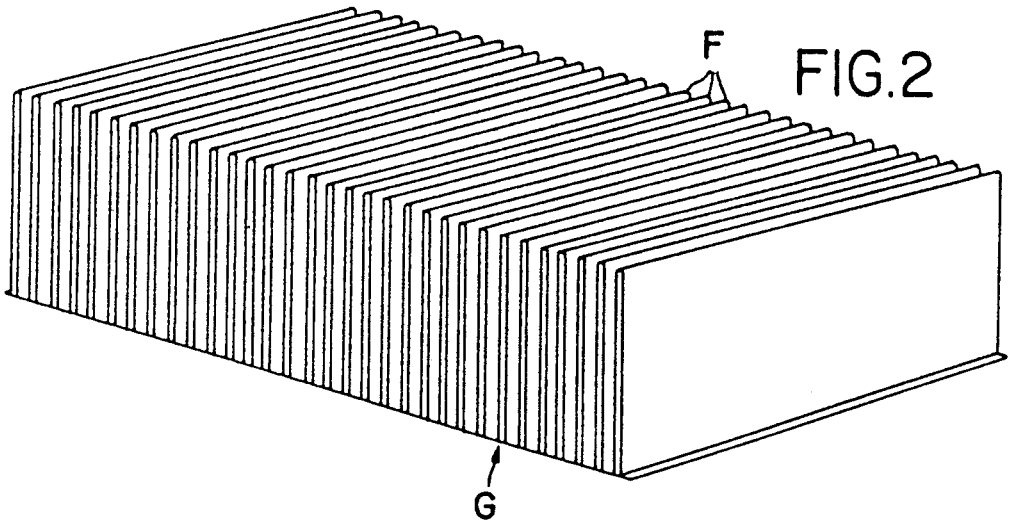
FIG. 2 is a schematic shown in perspective of the woven fabric structure of the invention.

Turning now to the drawings wherein like reference characters refer to like and corresponding parts throughout the several views, the thickness of woven fabric structure G of the invention is controlled by the height of integrally formed pleats F. The fabric structure comprises a first warp fabric system or section I forming the base warp, and a second warp fabric system or section II forming a plurality of generally parallel pleats.

As more clearly seen in FIGS. 5-9, weft yarns 1 and 2 of first warp section I support the pleats which are joined thereto. The second warp fabric section II has pleat wefts 3. Weft yarns 1 and 2 of section I are interwoven by warp yarns 4, and weft yarns 3 of the pleats of section II are interwoven by warp yarns 5. Moreover, warp yarns 5 of second section II interweave with weft yarns 1, 2 of first section I for integrally joining the two sections together, as clearly shown in FIG. 6, 8 and 9. The height of pleats F control the thickness of the woven fabric structure. Thus, there are fewer weft yarns 3 in each pleat depending on the height H desired. The maximum pleat height is determined by the distance between weaving reed 6 (FIG. 10) at the reed stop and the fabric take-off roll 7 of the weaving machine, and can be more than 10cm. Thus, the fabric take-off is in accordance with the desired weft density. Each time after reaching the desired weft number (weft no. = weft density × pleat height × 2), controlled by the dobby card of the weaving machine, the stop is effected. The basic warp threads 4 are shown in black outline in the drawings and warp threads 5 of the pleats are shown by double lines. Both sections I and II have their own warp beam rolls 8 and 9, respectively.

Figure 3:
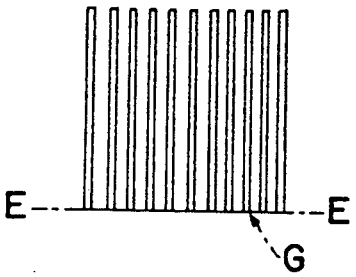
FIG. 3 is a side elevational view of the structure of FIG. 2.
Figure 4:
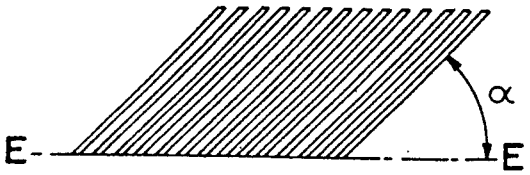
FIG. 4 is a view similar to FIG. 3 of another embodiment of the invention in which the pleats lie at an angle to the base fabric section of the structure.

All the pleats F are joined at their free double ends to the first warp fabric section as aforedescribed and extend from the same side of the basic fabric section I. And, the pleats are all the same height. In the FIGS. 3 and 9 embodiment, the pleats lie perpendicular to plane E—E of Section I of fabric G. Otherwise, the pleats can be interwoven such that first section I lies at an angle to plane E—E in overlapping relationship in a shingle-like manner.

Depending on the desired pleat height, more or fewer holding wefts 1 and 2 can be introduced. If, for example, a dense upstanding attitude of the pleats is desired as in FIG. 3, only one or two holding wefts 1, 2 are introduced. And the wefts can be of thinner material compared to that of weft yarns 3. However, if a desired angle is to be obtained for the pleats F in the finished structure, such angle is controlled by the height of the pleats in base section I.

By using more than one pleat chain (warp section II) it is possible to produce alternating pleats from varying warp and weft material. Other mixed forms are also possible and can be selected according to the desired purpose. Thus, for example, it is possible to use varying weft material by means of weft changes in the individual pleats F, so that a suitable structure can be produced.

Figure 10:
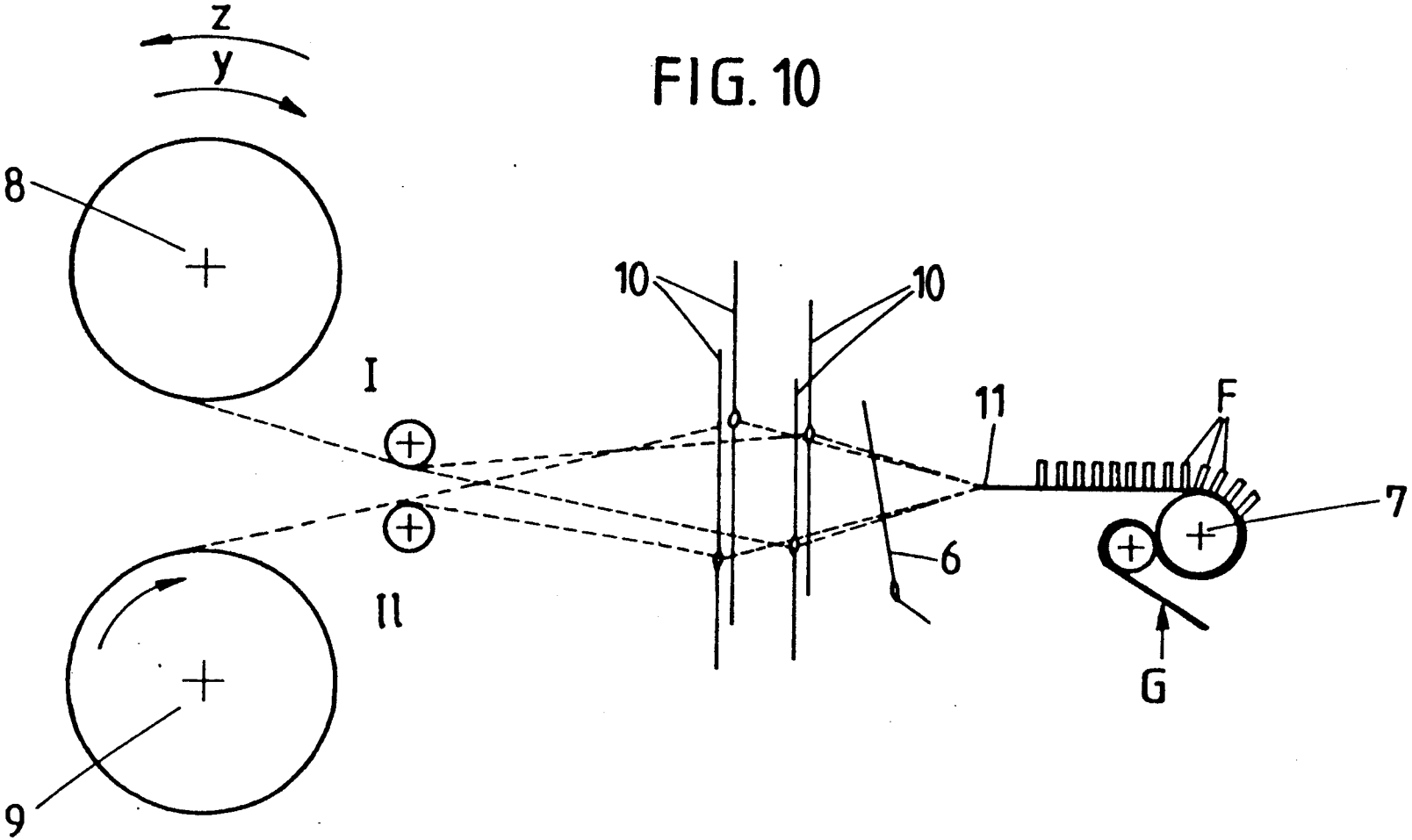
FIG. 10 is a schematic illustration of the essential elements of a weaving machine for the production of the pleated fabric structure according to the invention.

In accordance with the present process, generally illustrated in FIG. 10, the first warp fabric section I is stored on warp beam 8, and the second warp fabric section II is stored on warp beam 9. The sections progress in a conventional manner through beams 10 of the weaving machine. Weaving reed 6, via its reed stop (not shown), pushes the first holding weft yarn 1, 2 of the new pattern repeat into the second holding weft 1, 2 of the previous pattern repeat and throws the fabric, formed of the pleat warp and the pleat weft, into a pleat. Holding weft 2 also contributes to the further holding of the pleat. The weft take-off according to the weft density is in the direction of arrow Z and in the direction of the arrow associated with roll 9.

Figure 5:
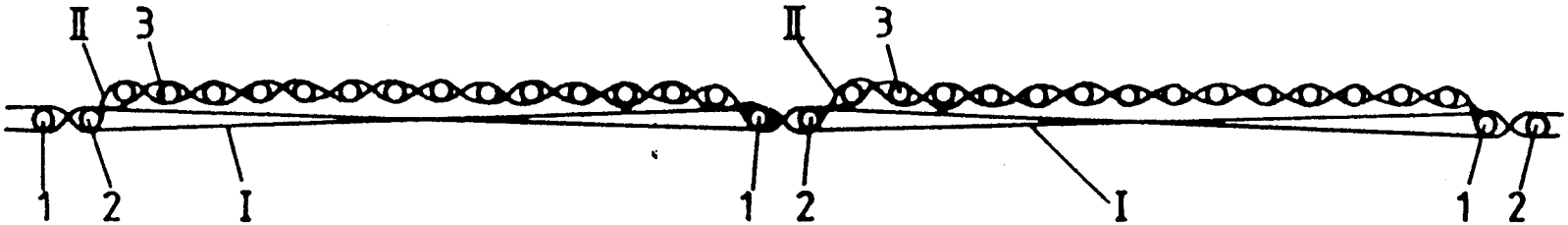
FIG. 5 is a schematic, transverse view taken through the fabric structure of the invention in the process of weaving and before the pleats are formed.

At juncture 11 shown in FIG. 10, the interwoven first and second sections are in a flat unpleated condition as shown in FIG. 5. Thus, first section I is woven as having sub lengths extending between weft yarn 2 (to the left in FIG. 5) to weft yarn 1 (at the center in FIG. 5), and from weft yarn 2 at the center in FIG. 5) to weft yarn 1 (at the right in this Figure). The corresponding sub-lengths of section II are equal to the sub-lengths of section I, as shown.

Figure 7:
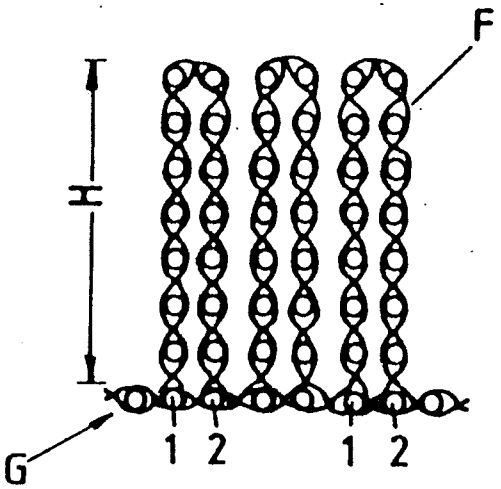
FIG. 7 is a view similar to FIG. 5 after the pleats have been formed and the sub-lengths of the first section are shortened.
Figure 6:
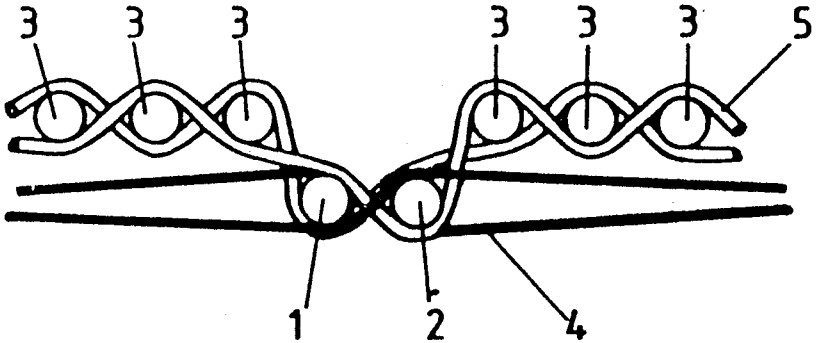
FIG. 6 is an enlarged view similar to FIG. 5 showing the interwoven joinder between the first and second sections.
Figure 8:
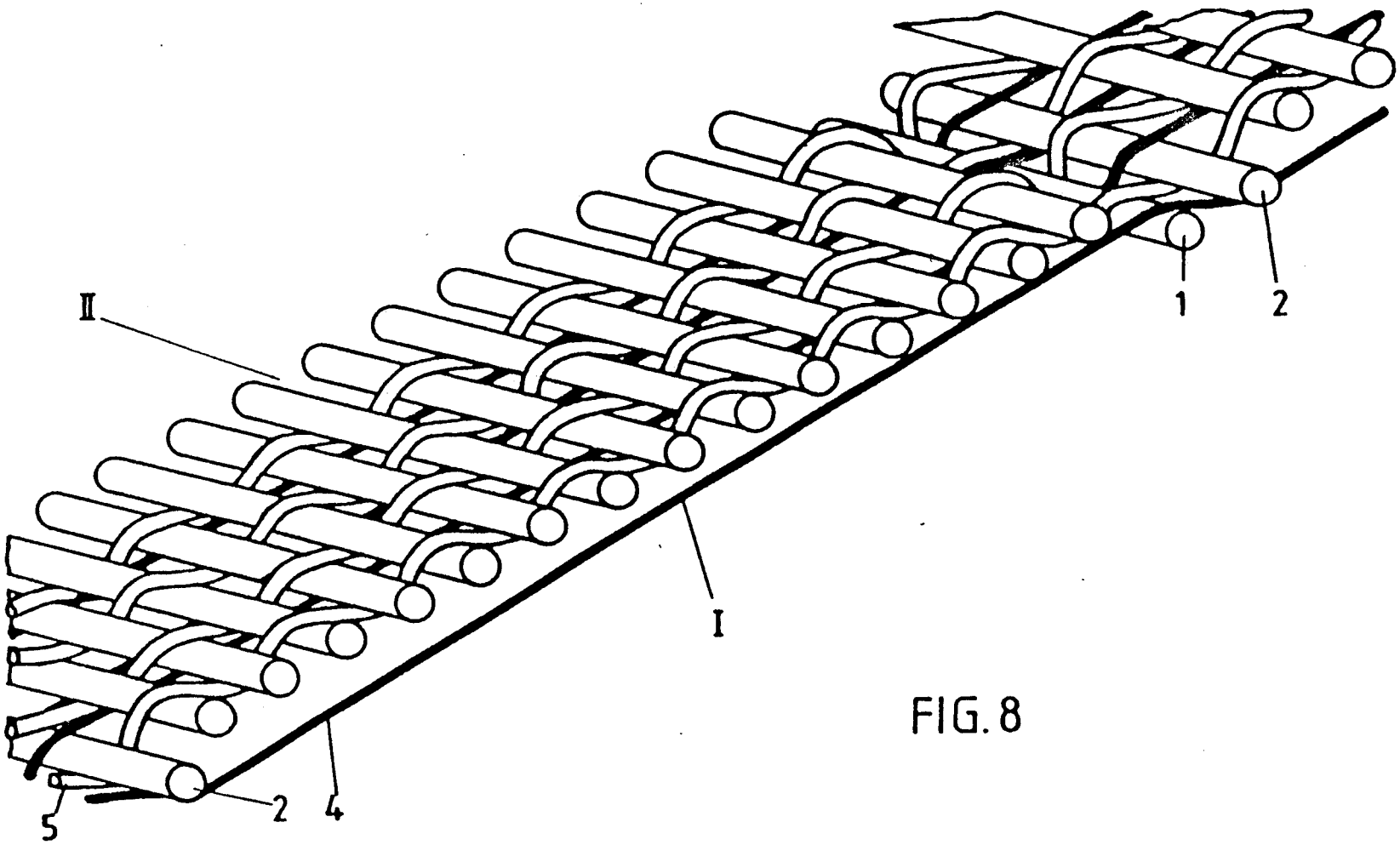
FIG. 8 is a perspective view of the structure shown in FIG. 5.
Figure 9:
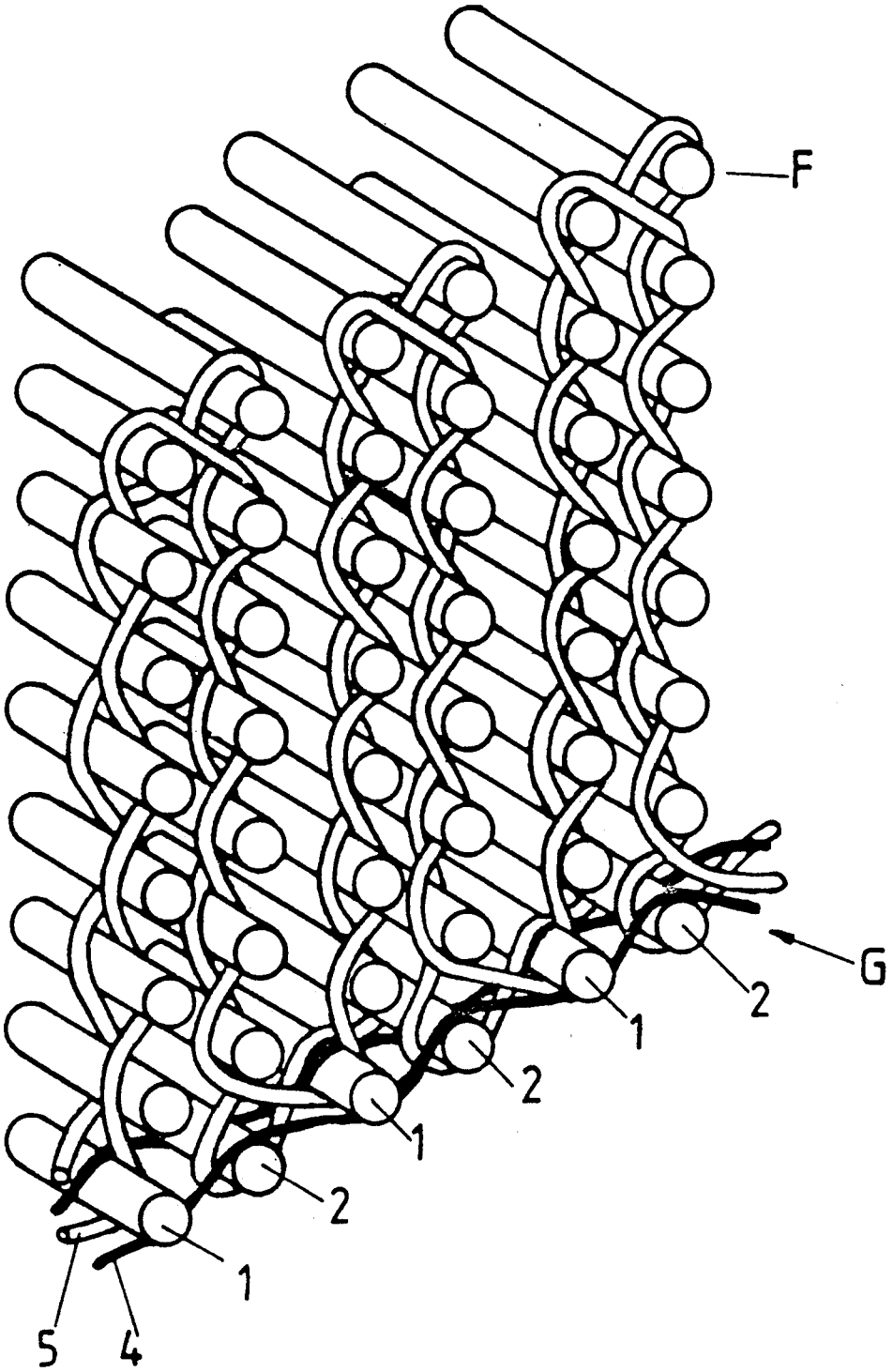
FIG. 9 is a perspective view of the structure shown in FIG. 7.

By means of an electronically controlled reversing device (not shown) fabric take-off roll 7 is reversely rotated by an amount equal to height H of the pleats to be formed, i.e., one-half the sub-length as aforedescribed. The pleats F as shown in FIGS. 7 and 9 are thus formed as warp yarns 4 of section I are shortened during the reverse movement of roll 7.

The thus loosened weave of section I is rolled back onto its warp beam roll 8 by means of a suitable motor (not shown) in the direction of arrow Y. After again attaining the working tension for the basic warp (section I) the weaving machine is automatically reinitiated.

The woven fabric according to the invention comprises high-performance fibers, such as glass fiber, aramide fiber, carton fiber, ceramic fiber, or a blend of such fibers. Fabric G, interwoven as aforedescribed, is then impregnated with a resin system to form a fabric structure having the desired rigidity for the purpose intended.

Woven fabric structure G is shown in FIG. 1 as lining an engine wall 13 which is essentially cylindrical although it may be of other desired shapes as permitted by the elasticity of the structure attained according to the invention. The flow of hot gases through lined cylinder 13 is shown in FIG. 1 by an arrow x.

Obviously, many other modifications and variations of the present invention are made possible in the light of the above teachings. It is therefore to be understood that within the scope of the appended claims the invention may be practiced otherwise than as specifically described.

What is claimed is:

1. A woven fabric structure capable of functioning as a lining for an engine wall, comprising a first warp fabric section and a second warp fabric section, said second section comprising a plurality of pleats integrally joined to said first section by warp threads of said second section interwoven with weft threads of said first section, the fabric comprising an industrial yarn selected from the group consisting of aramide fiber, carbon fiber, ceramic fiber, glass fiber and a blend of said fibers, and the fabric being impregnated with a resin system to form the fabric structure.

2. The structure according to claim 1, wherein the pleats of said second section each extend from one side of said first section.

3. The process according to claim 1, wherein the pleats lie parallel to one another and perpendicular to said first section.

4. The process according to claim 1, wherein the pleats lie parallel to one another and at an angle to said first section.

5. A process for manufacturing a woven fabric structure capable of functioning as a lining for an engine wall, comprising the steps of weaving a first warp fabric section to a first predetermined length having equal first sub-lengths, weaving a second warp fabric section to a second predetermined length having equal second sub-lengths, said sub-lengths being equal, interweaving said second section with said first section, forming pleats in said second section by shortening the sub-lengths of said first section, the fabric comprising an industrial yarn selected from the group consisting of aramide fiber, carbon fiber, ceramic fiber, glass fiber, and a blend of said fibers, and impregnating the fabric with a resin system to form the fabric structure.

6. The process according to claim 5, wherein said first section sub-lengths are shortened by reversely rotating a fabric take-off roll of a weaving machine employed in the process.

7. The process according to claim 6, further comprising the step of rewinding said first section on to a warp beam roll of the machine for tensioning the yarns of said first section.

* * * * *